US005145202A

United States Patent [19]

Miller

[11] Patent Number: 5,145,202

[45] Date of Patent: Sep. 8, 1992

[54] SNOWBOARD RELEASE BINDING

[76] Inventor: Earl A. Miller, P.O. Box 400, Orem, Utah 84057

[21] Appl. No.: 490,093

[22] Filed: Mar. 7, 1990

[51] Int. Cl.[5] ..... A63C 9/086

[52] U.S. Cl. ..... 280/613; 280/637; 280/14.2

[58] Field of Search ..... 280/613, 617, 618, 623, 280/634, 14.2, 809, 619, 637; 441/70, 73, 74, 75

[56] References Cited

U.S. PATENT DOCUMENTS

| | | | |
|---|---|---|---|
| 4,191,395 | 3/1960 | Solomon | 280/618 |
| 4,629,208 | 12/1966 | Gertsch et al. | 280/618 |
| 4,792,155 | 12/1988 | Besnier | 280/618 |
| 5,026,088 | 6/1991 | Stuart | 280/14.2 |

*Primary Examiner*—Andres Kashnikow
*Assistant Examiner*—Richard Camby
*Attorney, Agent, or Firm*—Craig S. Barrus

[57] ABSTRACT

A snowboard release binding consists of a boot holding plate which has vallate indents to engage a nipple in the release unit. As the boot holding plate is placed over the release unit, the nipple is depressed which allows the boot holding plate to be secured to the release unit. When the boot holding plate is twisted, turned or lifted in any of twelve angles of release, wall extensions around the vallate indent force the nipple to retract, thus freeing the rider's first foot from the snowboard. The second foot is similarly and instantaneously released, preventing injury by releasing the feet before damaging stresses can be applied to the legs and structure of a rider. A ski brake is also developed to prevent further travel of the snowboard, and when used in conjunction with a self-containing strap, will prevent injury to the rider and other skiers or snowboarders in the immediate area.

4 Claims, 7 Drawing Sheets 4
5
6
11
12

SNOWBOARD RELEASE BINDING

BACKGROUND OF THE INVENTION

1. Field of the Invention

The present Inventions relates in general to snowboards and in particular to binding release mechanisms for snowboards.

2. Prior Art

In the relatively new sport of snowboarding there exists an urgent need for a safe and effective release binding to detach the rider from the snowboard in the event of a fall. The problem has been mostly solved for the skiing industry through the development of several binding systems over the past 40 years. However, such ski bindings are unsuitable and unsafe for use in snowboarding because the ski boots are mounted across the snowboard, rather than parallel to the ski as is the case in skiing. The problem is compounded in that both feet must be released from the snowboard in order to prevent injury.

No device is known which will provide effective and safe release of a rider from his snowboard in all of the twelve angles of release.

Prior releasable ski bindings with release means under the boot include the releasable turntable, the Spademan binding, the Burt binding, and other models. All of these models are completely unusable and unsafe for use on snowboards for the following reasons:

A. A snowboard release binding cannot have anything in front of the toe or in back of the heel, because generally the toe and the heel may extend out over the edges of the snowboard.

B. A snowboard binding must have all twelve basic angles of release to afford instant release in every possible combination for each foot. The release angle for one foot may not be the same angle for the other foot in the same fall. Present ski bindings only have three of the twelve basic angles of release required for snowboard bindings. Should only one foot release, the heavy snowboard can literally tear the other leg and foot apart.

C. Snowboarders ride in a basic "surfer stance," which places them substantially at a right angle to the fall line. Because of this stance, the snowboarder is already stressing the knee joint and leg bones, and instantaneous release is required. In ski bindings, however, there is a much greater latitude for movement, and greater movement is allowed before the knee joints or legs are stressed sufficiently to cause injury.

Previously releasable bindings with release means under the ski boot have afforded only partial release possibilities and have been completely unsuitable to the use on the snowboard because of the danger of one foot release and the heavy snowboard acting as a fulcrum base with possible severe injury resulting. Also earlier bindings had no possible way to attach the soft snowboard binding to a releasing mechanism under the binding.

SUMMARY OF THE INVENTION

The present invention is applicable to both snowboards and skis, and solves the problem of insufficient angles of release by providing twelve angles of release which are required to disengage a rider from practically any fall from the ski or the snowboard. This is accomplished by having the ski boot attached to a boot holding plate. The boot holding plate has vallate indents on the bottom surface which receive a nipple from the releasing unit. A vallate indent is a depression around which exists a ridge or wall extension. This wall is extended farther out for the overhead release at the base of the vallate indent which results in a harder release for an upward movement of the boot holding plate. The wall tapers back to the median surface of each side of the vallate indent which allows a roll release of the boot from the bindings with only a partial movement of the nipple out of the cavity, with a resultant force less than required for an overhead pull out. The sideways release requires even less movement of the nipple out of the vallate indent and allows a sideways release with less force than required for the overhead or the roll release.

The tension of the releasing unit is adjustable to allow sufficient tension to hold the snowboard to the ski boot. However, in the event of a fall, any twisting or turning moments between the snowboard and the boot is immediately sensed and released. The raised wall extension around the nipple begins immediately to force the nipple to retract into the releasing unit. Because of the curved geometry of the nipple, the binding releases in any of the twelve modes of release required for safe and effective release of the snowboard. And as soon as the second foot starts to create an odd angle, it too is immediately released, freeing the rider from his snowboard before dangerous stresses can build up which would cause injury to the rider.

DETAILED DESCRIPTION

The present invention relates to a snowboard release binding which comprises a boot holding plate having a toe area and a heel area, means for holding said boot holding plate to a boot, and a release unit to removably engage said boot holding plate at said toe area and said heel area which allows said boot holding plate to be released from the snowboard in the event of a fall of the rider.

Figure 1:
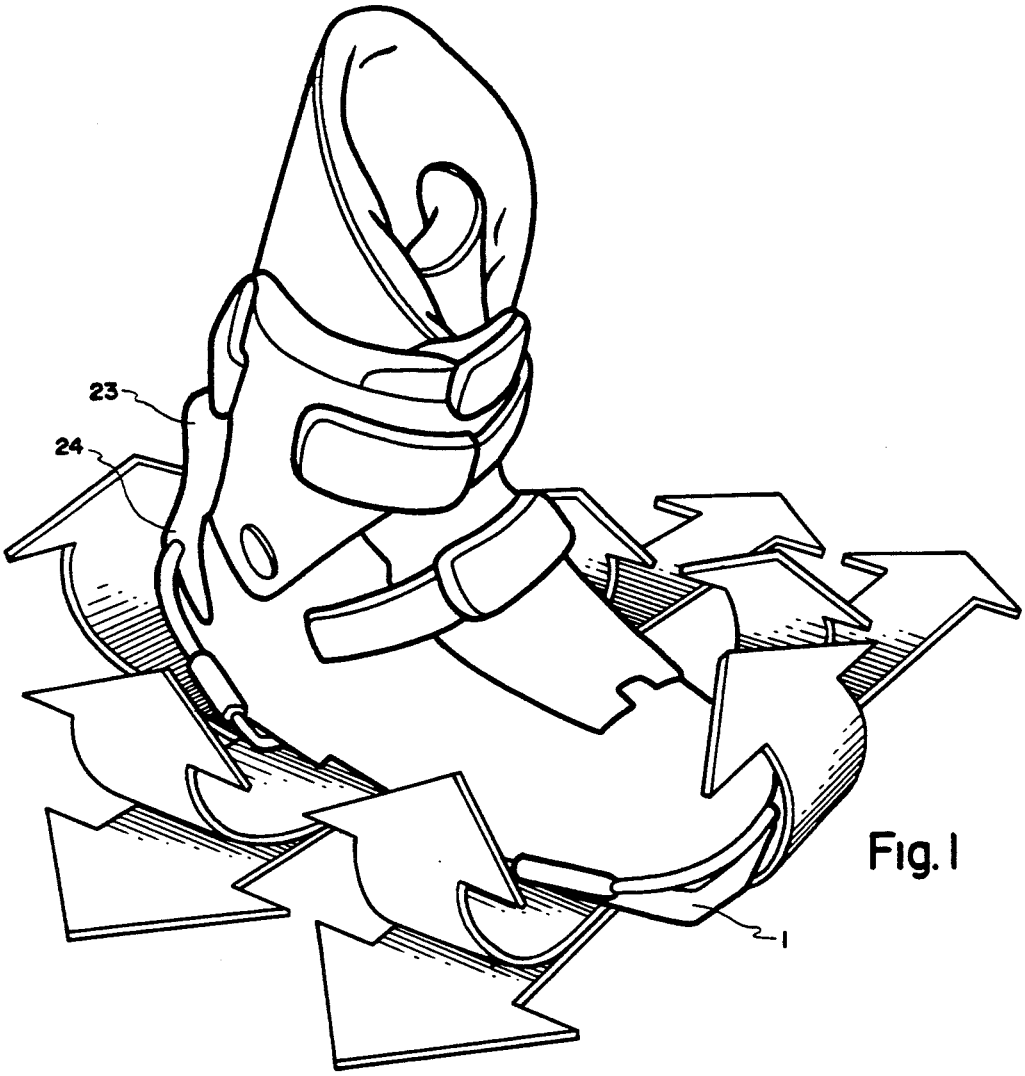
FIG. 1 is an fragmentary illustration of a ski boot in perspective showing the angles of release of the snowboard release binding, in accordance with the present invention.

Referring to the drawings, the snowboard release binding is detailed and shown in its various configurations. FIG. 1 shows the boot attached to the boot holding plate 1 and the various angles of release that the present invention permits. There are four angles of lateral movement left and right of the toe and the heel. There are two angles of roll for both the heel and the toe, for another four angles. There are two angles as the toe or the heel pull upwards for release. The final two angles are the straight lateral movement of the boot holding plate 1 left and right as the toe and heel release together. The present invention accomplishes all twelve angles, whereas present ski bindings only accomplish three angles which are a left front lateral release, a right front lateral release, and an upward heel release.

Figure 4:
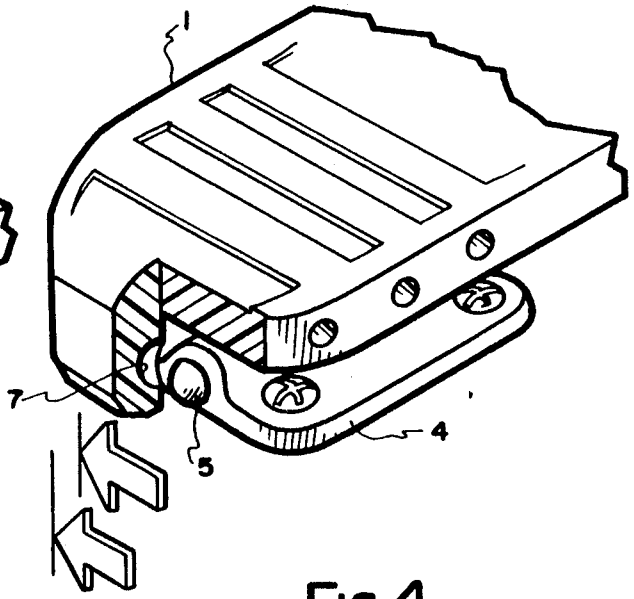
FIG. 4 is a fragmentary, top perspective of the boot holding plate and the release unit as the boot holding plate moves laterally and is released.
Figure 3:
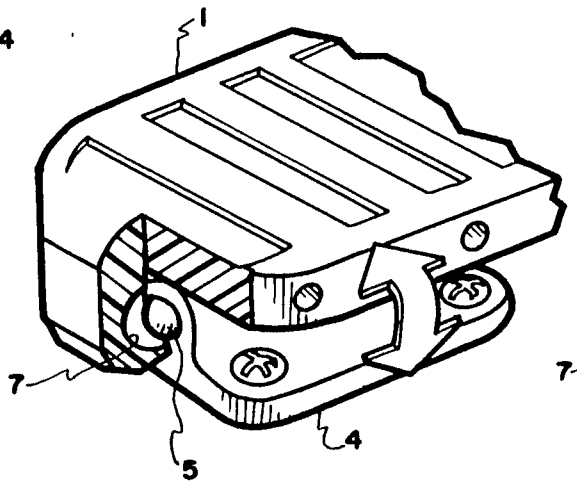
FIG. 3 is a fragmentary, top perspective of the boot holding plate and the release unit as the boot holding plate rolls around the longitudinal axis of the boot holding plate and is released.
Figure 2:
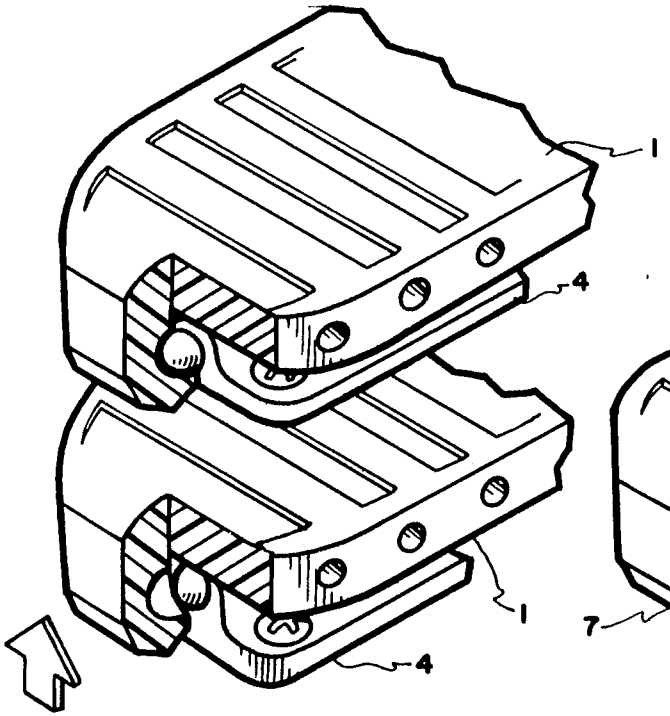
FIG. 2 is a fragmentary, top perspective drawing of the boot holding plate and the release unit as the boot holding plate lifts vertically upward and is released.

FIG. 2 shows the boot holding plate 1 removably attached to the release unit 4, and how the nipple 5 retracts into the release unit 4 to disengage the boot holding plate 1 when the boot holding plate 1 is pulled upward. FIG. 3 is similar, in that the boot holding plate 1 is shown releasing from the release unit 4 in a roll about the longitudinal axis along the boot holding plate 1. As can be seen, the nipple 5 retracts from the vallate indent 7 into the release unit 4 and releases the boot holding plate 1. FIG. 4 is also similar in showing the releasing action between the boot holding plate I and the release unit 4 as the boot holding plate moves laterally, in that the nipple 5 is forced into the release unit 4 which releases the boot holding plate 1.

Figure 5:
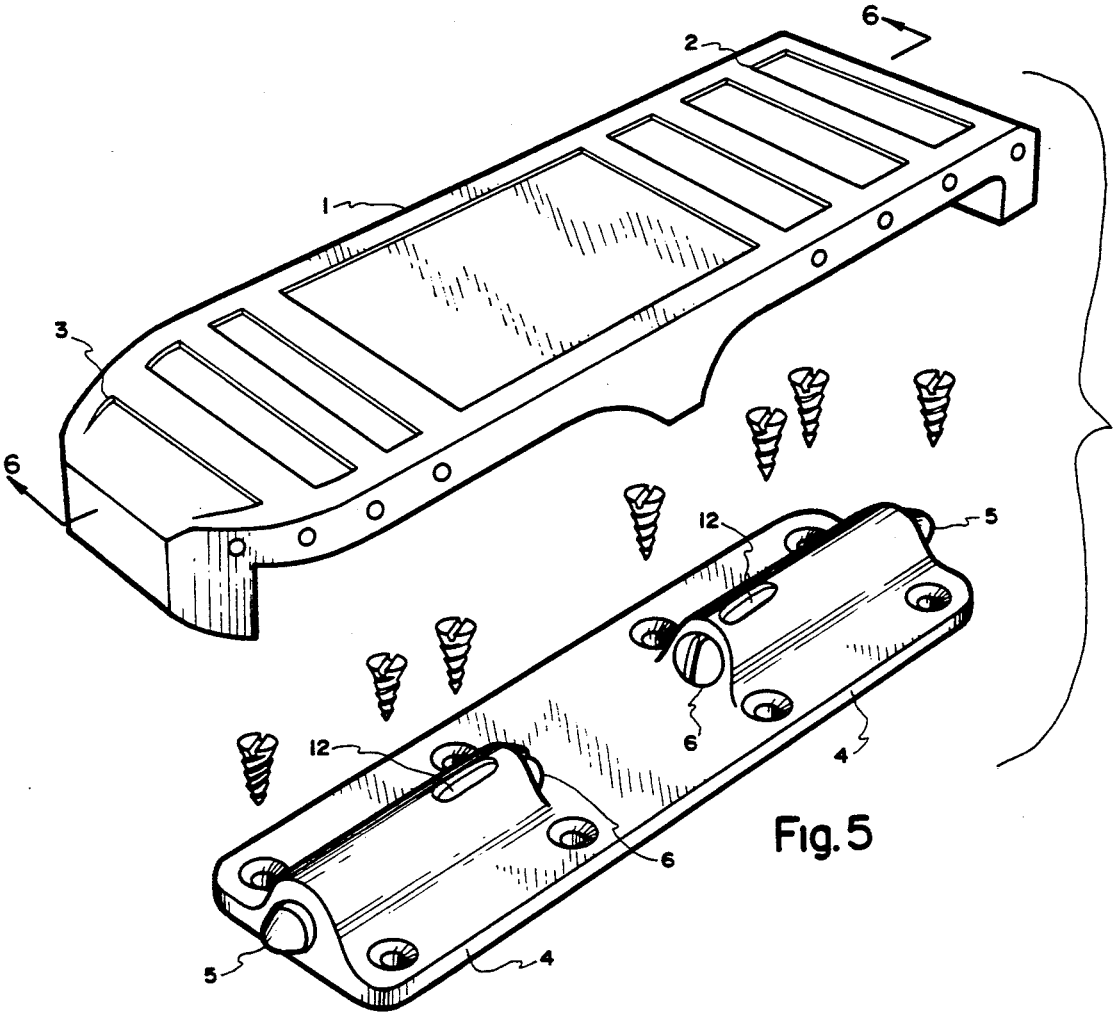
FIG. 5 is an exploded view perspective of the boot holding plate and the release unit.

The preferred snowboard release binding is shown in FIG. 5. The boot holding plate has a heel area 2 and a toe area 3 corresponding to the location of the boot to which it is secured. The boot holding plate 1 slides down over the release units 4, and a nipple 5 engages vallate indents 7 in the heel area 2 and the toe area 3 of the boot holding plate 1. FIG. 5 also shows a screw 6 as a means of adjusting the tension in the nipple 5 of release unit 4.

Figure 6:
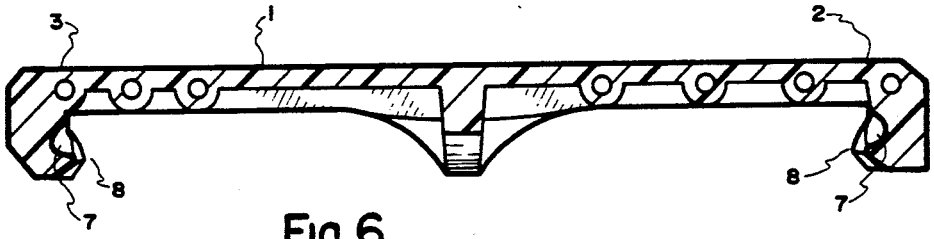
FIG. 6 is a section of the boot holding plate cut along the line 6—6 of the boot holding plate.

FIG. 6 shows a sectional view of the boot holding plate 1. The vallate indents 7 are apparent, as are the wall extensions 8 at the vallate indents 7. It is the wall extension 8 which accounts for the different forces required for the twelve degrees of release because the wall extension 8 contacts the nipple 5 in different angles, depending on the particular release mode.

Figure 7:
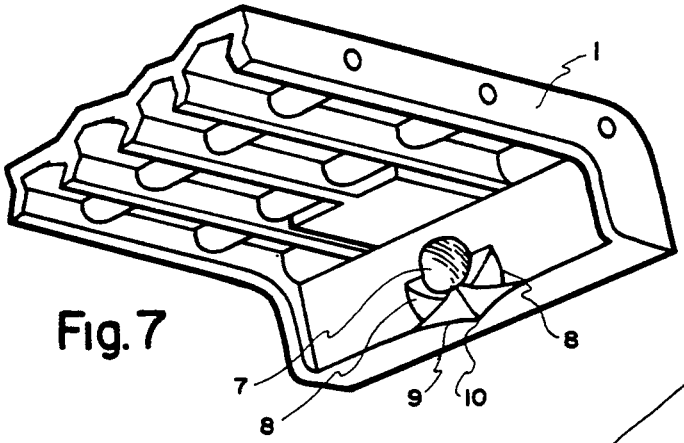
FIG. 7 is a fragmentary, bottom perspective of the boot holding plate and the vallate indent.

FIG. 7 shows the geometry of the vallate indent 7 of the boot holding plate 1. It would be possible to have the nipple 5 engage an indent or depression in the boot holding plate 1 without the vallate surfaces, but the preferred embodiment is a vallate indent having the configuration shown. The wall extension 8 forces the nipple 5 to disengage the boot holding plate 1 instantaneously as the boot holding plate 1 begins to twist or turn in anticipation of a fall of the rider. The cam angle 9 which is cut on the bottom portion of the boot holding plate 1 allows the boot holding plate 1 to slide easily over the nipple 5 until the nipple 5 engages and is seated in the vallate indent 7. To further assist with the alignment of the boot holding plate 1 with the release unit 4, an angular notch 10 is cut into the cam angle 9. With the angular notch 10 wider at the bottom than at the top, the boot holding plate 1 will essentially center itself over the nipple 5 during engagement. The vallate indent 7, wall extension 8, cam angle 9 and angular notch 10 are the same for the vallate indent in heel area 2 and the toe area 3.

Figure 8:
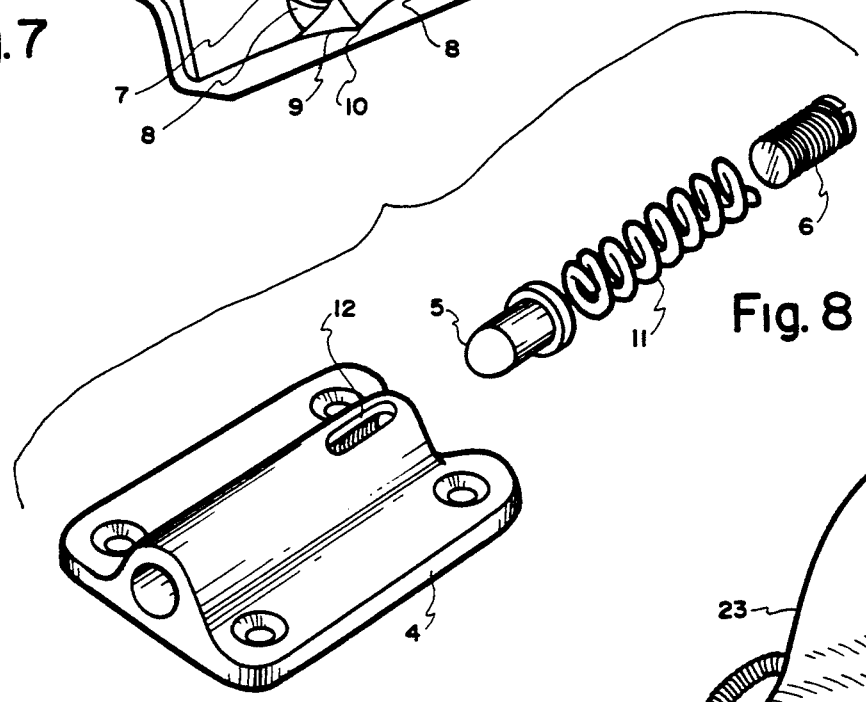
FIG. 8 is a top perspective drawing of a release unit.
Figures 15, 19, 20:
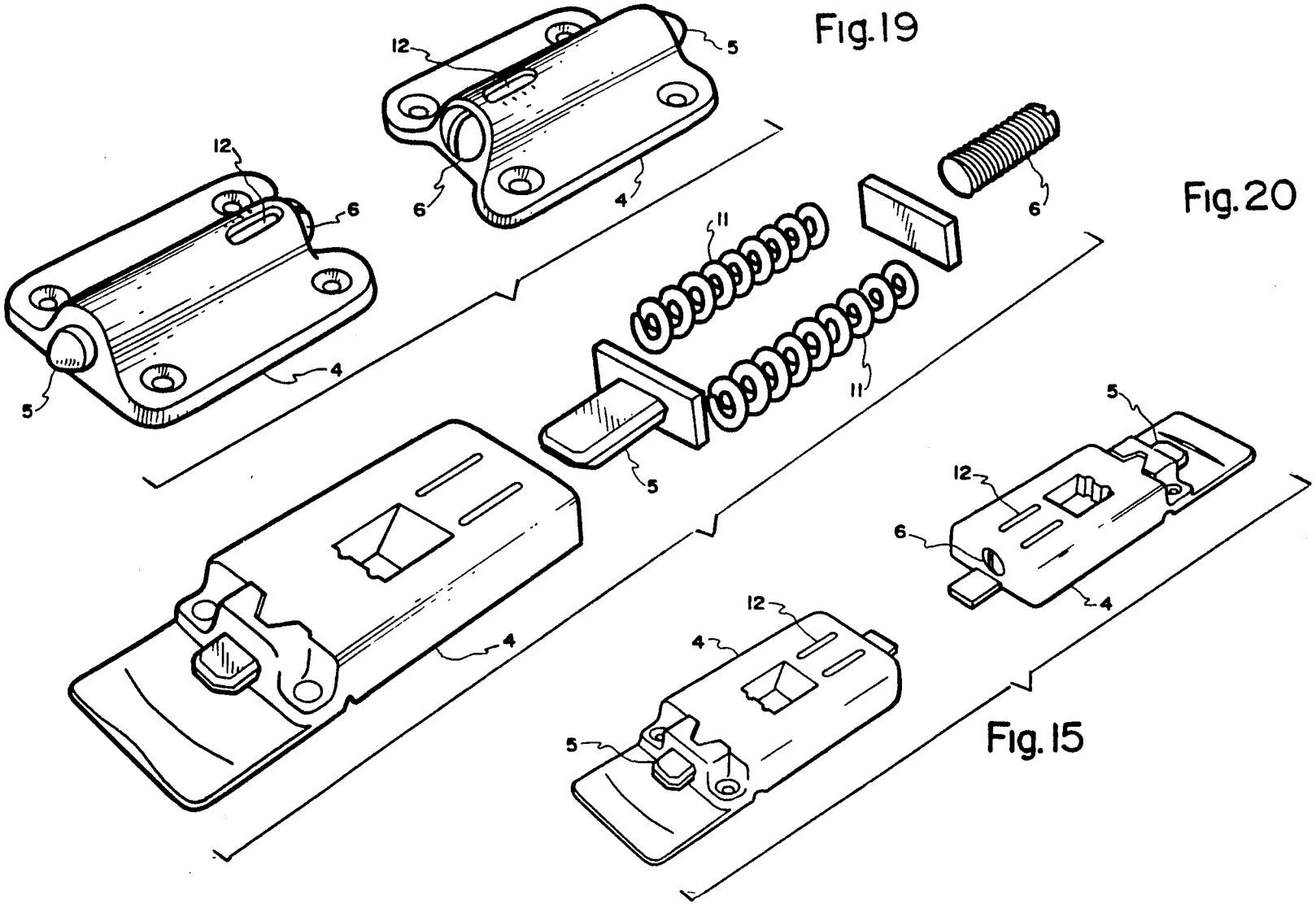
FIG. 15 is a top perspective of alternative release units in accordance with the present invention.
FIG. 19 is a perspective of a release unit comprised of separate release units.
FIG. 20 is a perspective of a release unit with a flat plate for a nipple.

FIG. 8 is an exploded view which shows the details for a typical release unit 4. A nipple 5 is inserted into the release unit 4 and partially extends outside of the release unit in order to engage the vallate indent 7 of the boot holding plate 1. Tension is provided by a spring 11 which is compressed to various tensions by a screw 6. The degree of tension is indicated by calibrated marks 12 on the release unit 4, which are calibrated in accordance with the DIN standards presently used internationally with ski bindings. Each boot holding plate 1 could have separate release units 4, and each snowboard would have a boot holding plate 1 for each foot of the rider. Alternative configurations are also shown in FIG. 15.

Figure 10:
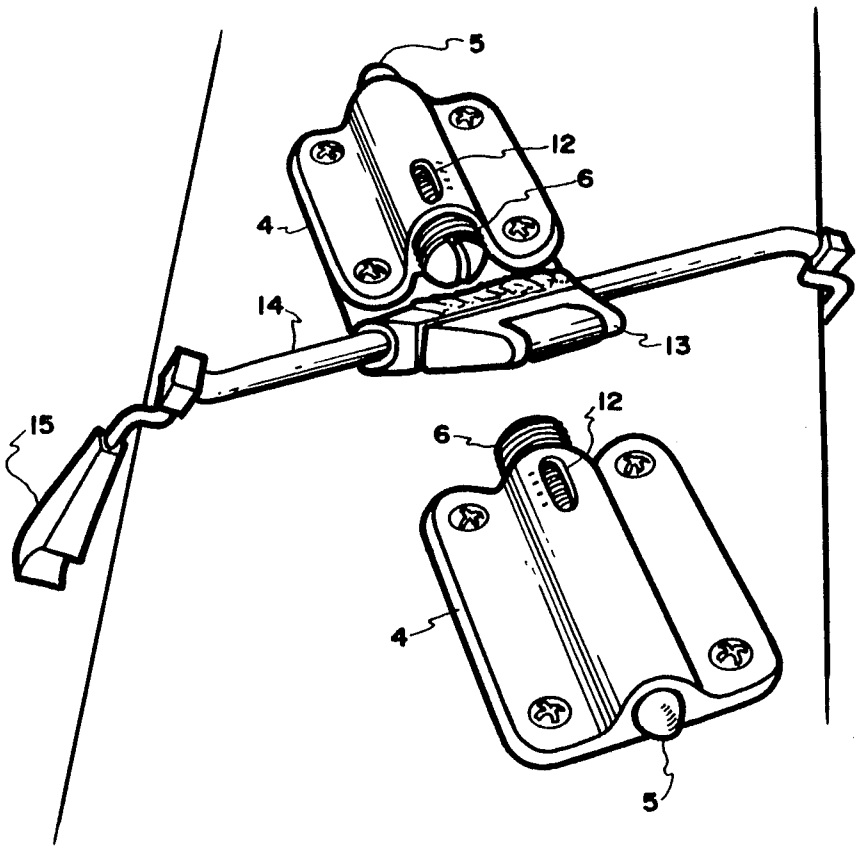
FIG. 10 is a top perspective of the ski brake in its "deployed" position.
Figure 9:
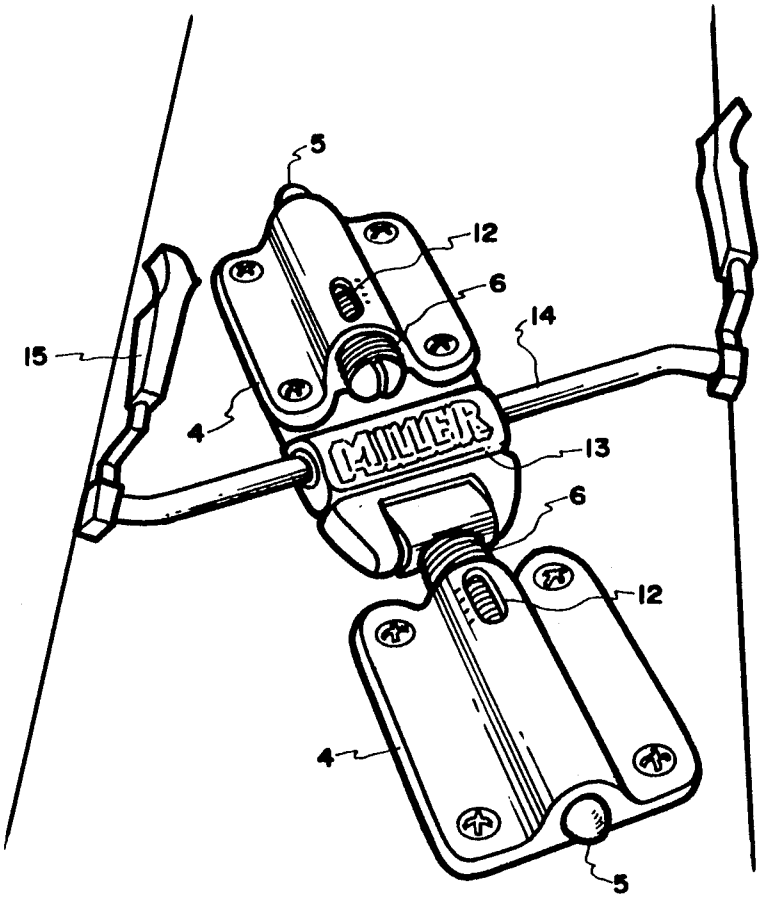
FIG. 9 is a top perspective of the ski brake in its "ready" position.

FIG. 9 shows the ski brake 13 mounted between release units 4. The tension arm 14 is connected to a braking arm 15, and torsion is created when the boot holding plate 1 compresses the ski brake 13. When the boot holding plate 1 is released, the tension arm 14. causes the braking arms 15 to extend downward and engage the snow, which retards the further travel of the snowboard. The deployed position is shown in FIG. 10.

Figure 11:
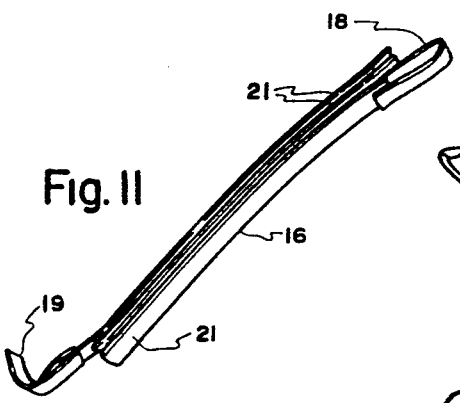
FIG. 11 is a side perspective of the self-containing strap.
Figure 12:
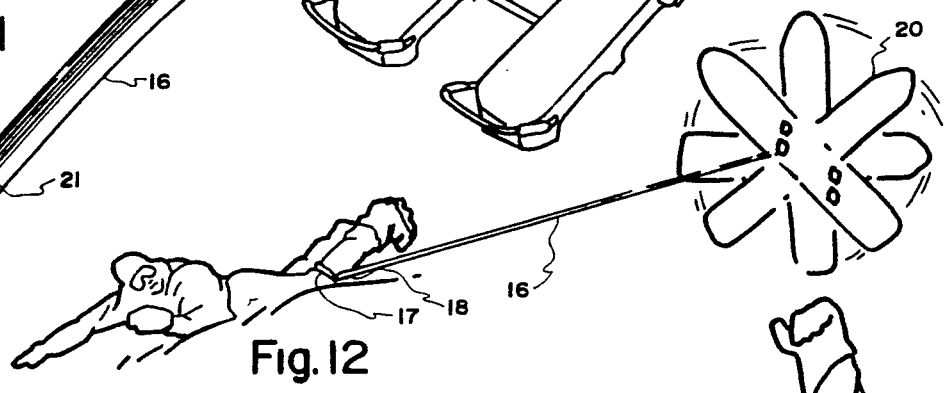
FIG. 12 is a perspective of the self-containing strap showing the strap in a deployed condition.
Figure 18:
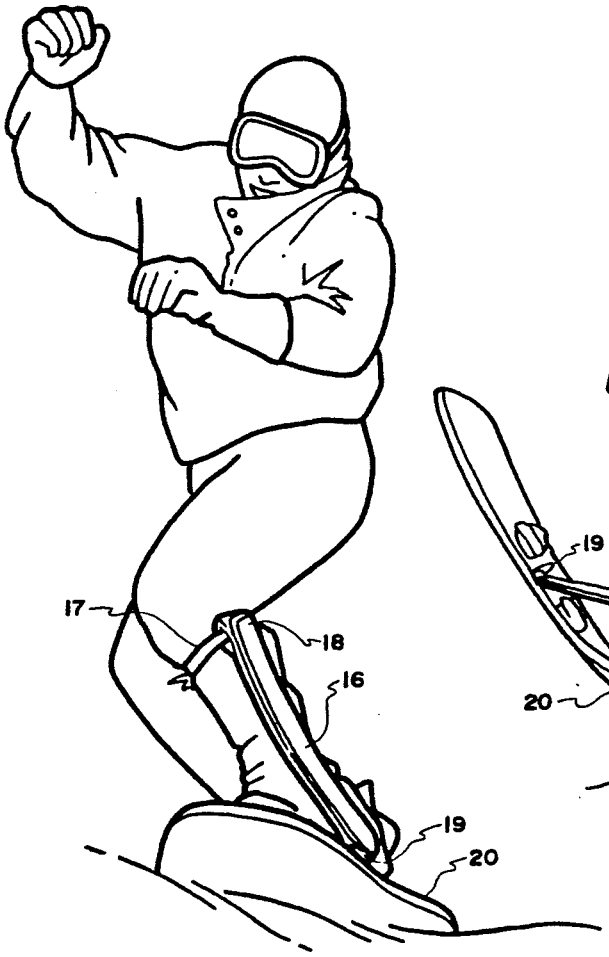
FIG. 18 is a perspective of the self-containing strap during normal use.
Figure 17:
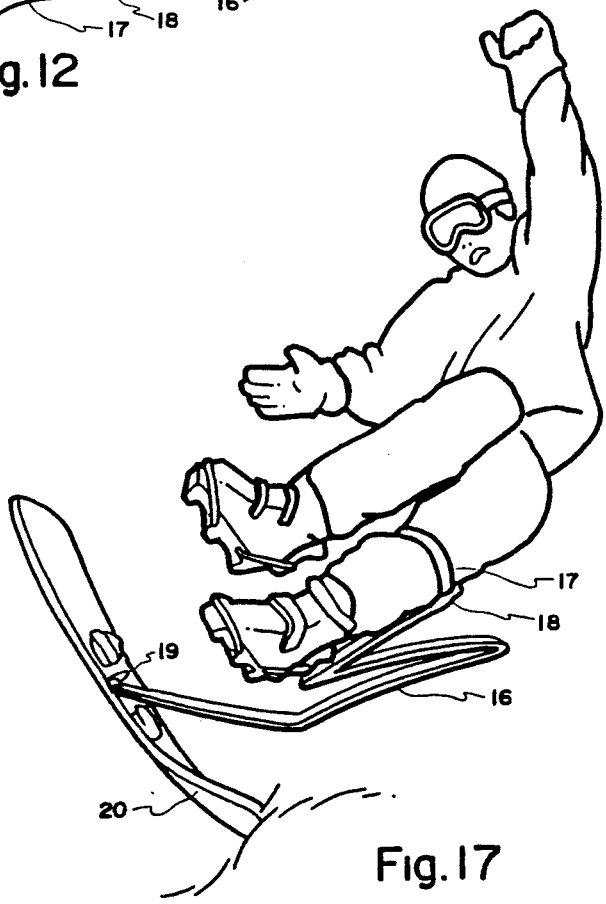
FIG. 17 is a perspective of the self-containing strap being deployed during a fall.

FIG. 11 shows the configuration of the self-containing strap 16. In operation, the self-containing strap 16 has alternate facings 21 of a hook and eye material, which allows the self-containing strap 16 to fold against itself and be self-containing. FIG. 18 shows the configuration of the self-containing strap while riding the snowboard, in that the top 18 of the self-containing strap 16 is secured to the rider's lower leg by a smaller strap 17, and the bottom 19 of the self-containing strap 16 is secured to the snowboard. The top 18 and bottom 19 of the self-containing strap 16 is made of resilient material to absorb the initial shock of disengagement from the snowboard. In FIG. 12 and FIG. 17, as the rider is disengaged, the self-containing strap 16 extends and eventually stops the forward travel of the snowboard by the weight of the rider.

FIG. 12 shows the self-containing strap 16 attached to a rider. As the rider falls, the self-containing strap 16 unfolds and restrains further movement of the snowboard.

Figure 13:
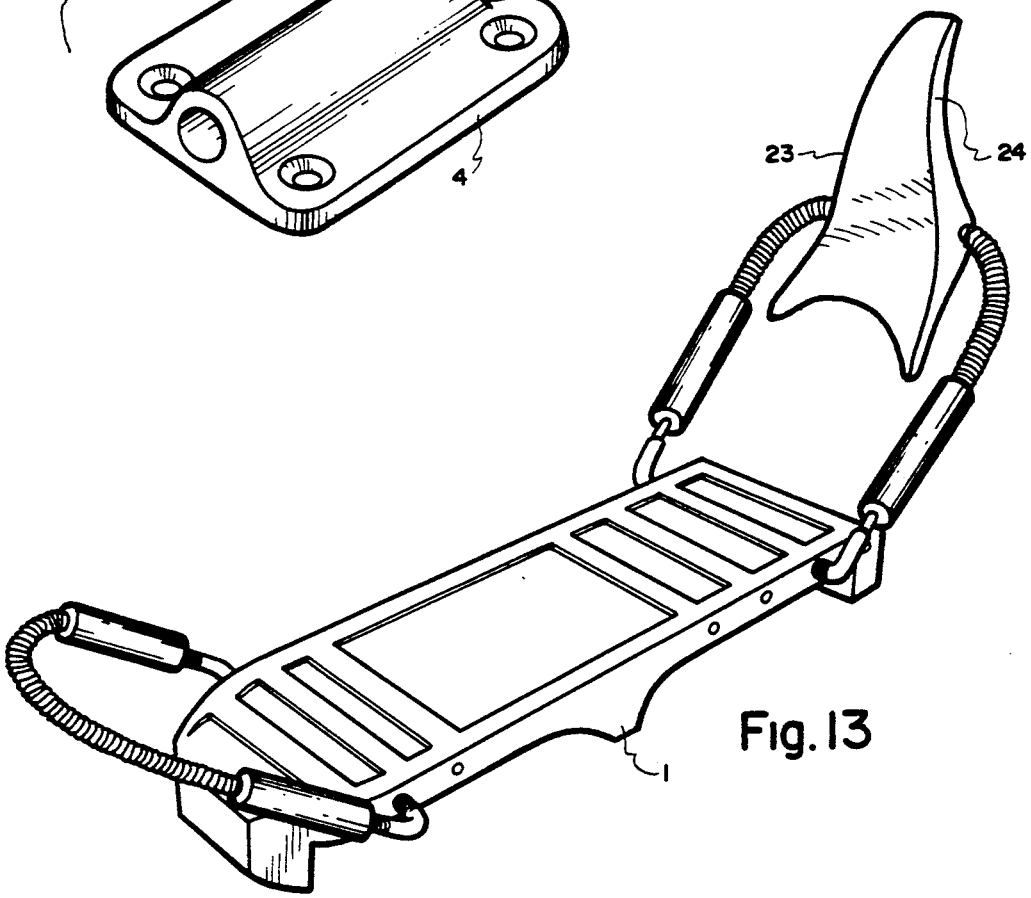
FIG. 13 is a top perspective of the boot holding plate with a heel lever.

FIG. 13 shows a means for securing a boot to the boot holding plate 1. A heel lever 23 is connected to the boot holding plate 1 and locks the boot to the boot holding plate 1. The extended protrusion 24 allows the rider to disengage the heel lever 23 from the boot by pushing the rider's ski pole against the extended protrusion 24.

Figure 14:
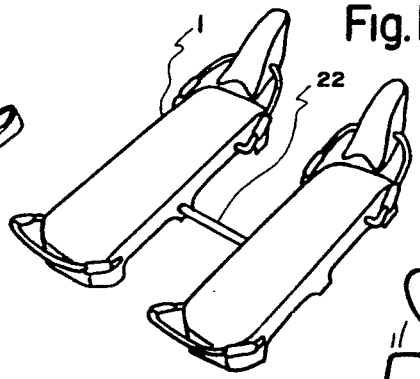
FIG. 14 is a top perspective of two boot holding plates connected together.

FIG. 14 shows two boot holding plates connected to each other by a connecting means 22. The connecting means 22 allow each boot holding plate 1 to swivel while at the same time allowing both boot holding plates to release almost simultaneously.

FIG. 15 shows some alternative configurations for release units 4. FIG. 19 shows a release unit 4 comprised of separate release units, unlike the continuous release unit 4 show in FIG. 5. The operation remains essentially the same. FIG. 20 shows a release unit 4 and a flat plate for nipple 5. Tension is provided by more than one spring 11 as compressed by screw 6. FIG. 15 shows the assembled release unit 4, with the flat plate 5 extended to engage a boot holding plate 1. Tension is indicated by marked graduations 12 on the release unit 4.

Figure 16:
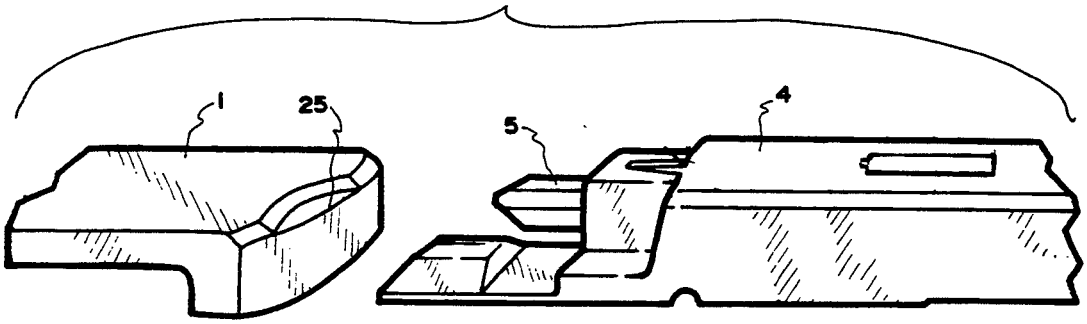
FIG. 16 is a side perspective of an alternate boot holding plate and release unit.

FIG. 16 shows an alternative configuration of the present invention. The release unit 4 has a flat plate nipple 5 for engaging an oval connecting surface 25 on the boot holding plate 1. As the boot holding plate 1 twists, turns, or lifts, the nipple 5 is forced to retract into release unit 4, thus releasing the boot holding plate 1.

Although the invention has been illustrated and described with reference to preferred embodiments, those skilled in the art will recognize that modification and variation in the structure may be made without departing from the spirit of the invention as described and illustrated above and as set forth in the claims.

Having illustrated and described the invention, what is claimed is:

1. A release binding comprising: (a) a boot holding plate having a toe and a heel area; and (b) at least one release unit which engages said boot holding plate at said heel area and at said toe area to removably secure said boot holding plate to the snowboard, each said heel area and each said toe area having a vallate indent which engages said release unit, wherein each said vallate indent has wall extensions, wherein said wall extensions are higher in one area of the peripheral edge of said vallate indents and taper to the mean surface on each side of said wall extensions, so as to provide differing release forces.

2. A release binding as in claim 1 wherein said wall extensions of the said vallate indents protrude more on the bottom of said vallate indent and tapers back on each side to the median surface of said vallate indent.

3. A snowboard release binding comprising a boot holding plate having a toe area and a heel area; means for holding said boot holding plate to a boot; and at least one release unit which engages said boot holding plate at, at least one of said heel area and said toe area, which further includes a self-containing strap having a top end attached to the rider's leg and a bottom end attached to the snowboard, said self-containing strap having alternating multiple facings of hook and eye materials so that said self-containing strap folds against itself, so that when the rider becomes disengaged from the snowboard, said self-containing strap unfolds and prevents further travel of the snowboard.

4. A release binding as in claim 3 wherein said top end and said bottom end of said self-containing strap have a resilient material to reduce the snap of the snowboard against the rider's leg as the snowboard is released.

* * * * *